US006040129A

United States Patent [19]

Godleski et al.

[11] Patent Number: 6,040,129

[45] Date of Patent: Mar. 21, 2000

[54] PHOTOGRAPHIC EMULSION HAVING AN IMPROVED SPEED, PHOTOGRAPHIC ELEMENT CONTAINING SAID EMULSION, AND METHOD

[75] Inventors: Stephen A. Godleski, Fairport; David A. Dickinson, Brockport; Antony J. Williams, West Henrietta, all of N.Y.

[73] Assignee: Eastman Kodak Company, Rochester, N.Y.

[21] Appl. No.: 09/288,900

[22] Filed: Apr. 9, 1999

[51] Int. Cl.[7] ..... G03L 1/08

[52] U.S. Cl. ..... 430/604; 430/569; 430/612; 430/613

[58] Field of Search ..... 430/569, 604, 430/612, 613, 614

[56] References Cited

U.S. PATENT DOCUMENTS

| | | | |
|---|---|---|---|
| 2,487,850 | 11/1949 | Carroll . | |
| 2,518,698 | 8/1950 | Lowe et al. . | |
| 2,521,925 | 9/1950 | Lowe et al. . | |
| 2,983,609 | 5/1961 | Allen et al. . | |
| 2,983,610 | 5/1961 | Allen et al. . | |
| 3,779,777 | 12/1973 | Bigelow . | |
| 3,782,959 | 1/1974 | Bigelow . | |
| 3,930,867 | 1/1976 | Bigelow . | |
| 4,150,093 | 4/1979 | Kaminsky et al. . | |
| 5,260,176 | 11/1993 | Otani et al. | 430/604 |
| 5,888,717 | 3/1999 | Bergthaller et al. | 430/612 |

FOREIGN PATENT DOCUMENTS

| | | |
|---|---|---|
| 369491A | 5/1990 | European Pat. Off. . |
| 789823 | 1/1958 | United Kingdom . |

*Primary Examiner*—Thorl Chea
*Attorney, Agent, or Firm*—Edith A. Rice

[57] ABSTRACT

A photographic emulsion comprising dispersed in a binder sensitized silver halide grains wherein the emulsion is sensitized from an organometallic compound of formula:

$$(R)_n(X)_mM \qquad (I)$$

wherein M is a metal selected from the group consisting of lead, tin, boron, bismuth and thallium, each R is independently an alkyl group, a cycloalkyl group, an aryl group, a heterocyclic group, an alkenyl group or a alkynyl group, each X is independently halogen, hydroxy, or alkoxy, n is 1 to 4 and m is 0 to 3, with the proviso that when M is lead or tin, n is 1 to 4 and m+n is 4, when M is boron or bismuth, n is 1 to 3 and m+n is 3 and when M is thallium, either n is 1 and m is 0, or n is 1 to 3 and n+m is 3.

13 Claims, No Drawings

PHOTOGRAPHIC EMULSION HAVING AN IMPROVED SPEED, PHOTOGRAPHIC ELEMENT CONTAINING SAID EMULSION, AND METHOD

FIELD OF THE INVENTION

This invention relates to a silver halide photographic emulsion having an enhanced speed, a photographic element containing said emulsion, and the method for obtaining said emulsion.

BACKGROUND OF THE INVENTION

In recent years, it has been increasingly desired for silver halide photographic materials with improved photographic properties, such as sensitivity, graininess, gradation, sharpness, good keeping, and suitability to rapid processing especially of development. In particular, the demands for improving good keeping while minimizing fog and for further increasing sensitivity are strong.

Reduction sensitization has conventionally been studied for increasing sensitivity. Reduction sensitizers which have been proved useful for reduction sensitization of silver halide emulsions include stannous chloride (U.S. Pat. No. 2,487,850), polyamines or cyclic amine compounds (U.S. Pat. Nos. 2,518,698, 2,521,925 and 3,930,867), thiourea dioxide (aminoiminomethanesulfinic acid) type compounds (British patent 789,823 and U.S. Pat. No. 2,983,609 and 2,983,610), borane compounds (U.S. Pat. Nos. 3,779,777, 3,782,959, and 4,150,093), and ascorbic acid (EP 369491A). A comparative study of the silver nuclei formed by various reduction sensitization methods is described in Collier, Photographic Science and Engineering, Vol. 23, p. 113 (1979), in which the author uses dimethylamine borane, stannous chloride, and hydrazine as reduction sensitizers and adopts a high pH ripening method and a low pAg ripening method.

Strong reducing agents, such as hydrogen, $SnCl_2$, amine boranes, and sodium borohydride, typically possess much more reducing power than would be required to create silver centers (R-centers) on a silver halide grain, and this feature often makes them difficult to control. The required stiochiometry of reducing agents is difficult to control and often gives over reduction which is readout as fog. The usual manifestation of this lack of control is "over-reduction" or creation of too large cluster, providing fog on the photographic element. Reduction of other emulsion components, including possible interactions with gelatin functionalities, adds further complications to the use of these agents. Even if successfully formed, reduction centers appear to often be unstable, and provide poor keeping.

So, reduction sensitization generally tends to cause noticeable fog when combined with gold sensitization, and a reduction sensitized emulsion has particularly poor keeping.

Accordingly, it has been keenly demanded to develop a method of reduction sensitization which provides a silver halide emulsion of low fog and satisfactory preservability.

SUMMARY OF THE INVENTION

One object of this invention is to provide a photographic emulsion sensitized by reduction sensitization (R-typing) without the drawbacks of the known reduction sensitization.

A second object of the invention is to provide a photographic emulsion wherein the sensitivity is increased by R-typing in a controlled manner without producing undesired fog.

Another object of the invention is to provide a method for improving the latent image keeping.

Other and fuither objects of the invention will appear from the description of the present specification.

The objects of the present invention may be achieved by a photographic emulsion comprising dispersed in a binder sensitized silver halide grains wherein the emulsion is sensitized from an organometallic compound of formula:

$$(R)_n(X)_mM \qquad (I)$$

wherein M is a metal selected from the group consisting of lead, tin, boron, bismuth and thallium, each R is independently an alkyl group, a cycloalkyl group, an aryl group, a heterocyclic group, an alkenyl group or a alkynyl group, each X is independently halogen, hydroxy, or alkoxy, n is 1 to 4 and m is 0 to 3, with the proviso that when M is lead or tin, n is 1 to 4 and m+n is 4, when M is boron or bismuth, n is 1 to 3 and m+n is 3 and when M is thallium, either n is 1 and m is 0, or n is 1 to 3 and n+m is 3.

A second object of the invention relates to a photographic element comprising at least one silver halide emulsion and a support wherein the emulsion comprises dispersed in a binder sensitized silver halide grains, the emulsion being sensitized from the organometallic compound (I).

Another aspect of the invention relates to a method for sensitizing a photographic silver halide emulsion containing dispersed in a binder silver halide grains, comprising the step of adding to the emulsion the organometallic compound (I).

Another aspect of the invention relates to a method for improving the image latent keeping of a photographic element comprising a support having thereon a silver halide emulsion layer, the method comprising the step of adding to the emulsion an organometallic compound of formula (I).

ADVANTAGES OF THE PRESENT INVENTION

The organometallic compound (I) useful in the emulsion of the present invention provides an enhanced sensitivity through reduction sensitization of silver halide emulsions. Organometallic compounds (I) are not inherently reducing agents like the conventional reducing agent usually used for sensitization of silver halide emulsion. Organometallic compounds (I) accomplish the R-typing by a transmetallation with silver halide. The organometallic compound (I) is capable of undergoing ligand exchange with silver halide to form an organosilver intermediate (R-Ag). Such an organosilver intermediate has a very significant propensity to undergo bond homolysis. This homolytic process creates the desired silver atoms (R-center) necessary for reduction sensitization thus providing reduction sensitization and enhancement of photographic sensitivity.

Since the organometallic compounds (I) are not inherently a reducing agent they will not be reactive with any other elements contained in the emulsion (e.g., gelatin functionality). The organometallic compounds of formula (I) give advantages with respect to the control of the amount of R-center being produced.

The transmetallation agents rely on ligand exchange to form the active R-center (R-Ag). The rate of this process can be advantageously tuned over a very broad time range by the selection of the organic group R. For example, R groups having a hydrophilic ability or R groups capable of adsorbing on the silver halide would efficiently improve the R-center formation and thus the R-typing ability of the organometallic compounds (I). From the present invention, reduction sensitization can occur over a highly controlled time period. It is thus possible with the present invention to tune the reduction sensitization.

When reduction sensitized is performed according to the invention, the emulsion of the present invention also exhibits an improvement of the latent image keeping (LIK).

DETAILED DESCRIPTION OF THE INVENTION

When reference in this application is made to a particular group, unless otherwise specifically stated, the group may itself be unsubstituted or substituted with one or more substituents (up to the maximum possible number). For example, "alkyl" group refers to a substituted or unsubstituted alkyl group, while "benzene" refers to a substituted or unsubstituted benzene (with up to six substituents). The substituent may be itself substituted or unsubstituted.

Generally, unless otherwise specifically stated, substituents include any substituents, whether substituted or unsubstituted, which do not destroy properties necessary for the photographic utility. Examples of substituents include known substituents, such as: halogen, for example, chloro, fluoro, bromo, iodo; alkoxy, particularly those "lower alky" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, fluryl, pyrrolyl); acid or acid salt groups such as any of those described below; and others known in the art. Alkyl substituents may specifically include "lower alkyli" (that is, having 1–6 carbon atoms), for example, methyl, ethyl, and the like. Further, with regard to any alkyl group or alkylene group, it will be understood that these can be branched or unbranched and include ring structures.

As previously stated, R is independently selected from alkyl, cycloalkyl, aryl, heterocyclic, alkenyl or alkynyl.

Illustrative alkyl groups preferably contain 1 to 20 carbon atoms, more preferably 1 to 10 carbon atoms and most preferably 1 to 6 carbon atoms. Alkyl groups consist of straight or branched chains and include, for example, methyl, ethyl, propyl, isopropyl, butyl, sec-butyl, tert-butyl, pentyl, sec-pentyl, hexyl, decyl, dodecyl, and the like.

Cycloalkyl groups preferably contain 3 to 20 carbon atoms, more preferably 3 to 10 carbon atoms and most preferably 3 to 6 carbon atoms. Illustrative cycloalkyl groups include, for example, cyclopropyl, cyclobutyl, cyclohexyl, cycloheptyl, and the like.

Aryl groups contain 6 to 20 carbon atoms, more preferably 6 to 12 carbon atoms and most preferable 6 to 10 carbon atoms. Illustrative aryl groups include, for example, phenyl, naphthyl, and the like.

Heterocyclic groups can be aromatic or non-aromatic and contain at least one heteroatom, such as oxygen, nitrogen, sulfur, selenium, and the like. Heterocyclic groups preferably contain a total of 3 to 20 atoms, preferably 3 to 12 atoms and most preferably 3 to 10 atoms. Illustrative heterocyclic groups include furyl, pyridyl or thienyl group, and the like.

Illustrative alkenyl groups preferably contain 2 to 20 carbon atoms, more preferably 2 to 10 carbon atoms and most preferably 2 to 6 carbon atoms. Alkenyl groups consist of straight or branched chains and include, for example, vinyl, propenyl and the like. The alkenyl group can be a β-unsaturated alkenyl group, for example, allyl, benzyl group, and the like.

Illustrative aikynyl groups preferably contain 2 to 20 carbon atoms, more preferably 2 to 10 carbon atoms and most preferably 2 to 6 carbon atoms. Alkynyl groups consist of straight or branched chains and include for example propynyl, butynyl and the like.

The R groups can include hydrophilic groups which provide water solubility to the organometallic compound (I). These groups are for example R groups substituted with $CO_2^-$ or $SO_3^-$ group.

The R groups can also include groups enhancing the adsorption of the organometallic compounds (I) to the surface of the silver halide. These groups are for example mercapto, thioether, mercaptotetrazole.

R is preferably selected from the group consisting of alkyl or alkenyl group, more preferably selected from vinyl or allyl. Most preferably, R is allyl group.

According to a preferred embodiment, the organometallic compound has the following formula (Ia):

$$(R)_n(X)_mSn$$

wherein R, X, n and m are as defined above.

More preferably, the organometallic compound has the following formula (Ib):

$$R_4Sn$$

wherein R is as previously disclosed. In this embodiment, R is more preferably, a group alkyl or alkenyl group, preferably R is selected from vinyl or allyl. Most preferably, R is allyl group.

The organometallic compounds (I) that can be used in the emulsion of the present invention are for example, tetravinyltin, vinyltributyltin, tetraallyltin, tetraphenyltin, divinyltin dichloride, dimethyltin dichloride, tetramethyltin, diallyltin dibromide, diphenyltin dichloride, allyltrimethyltin, and the like.

In the silver halide emulsion of the invention, the organometallic compound of formula (I) is present in an amount capable of enhancing the sensitivity of the photographic element. The amount that needs to be added to the emulsion varies in a large range depending on the nature of the R groups, the silver halide grain, the activity of the organometallic compound itself, etc. The amount of the organometallic compound in the photographic element can then varied from 0.001 to 1.5 mmol/silver mole.

The present invention also relates to a method for obtaining the emulsion of the present invention. In this method, the organometallic compound (I) is added to the emulsion in a conventionnal manner at any time and stage of the preparation of the silver halide emulsion. However, it is preferred to add the organometallic compound (I) during the final step.

The addition of the organometallic compound in the emulsion can be followed by thermal treatment wherein, the temperature of the emulsion can be raised to a temperature from 40° C. to 60° C. and held for a period of time sufficient to enhance the sensitivity of the element, preferably to complete the reaction, typically 5 to 10 min.

The organometallic compound (I) is preferably added to the silver halide emulsion in the form of a solution. Solvents that can be used for this purpose are water or water-miscible solvents, for example methanol, acetonitrile, and the like.

The sensitization method of the present invention can be carried out from a silver halide emulsion previously chemically sensitized. Conventional chemical sensitization includes sulfur and/or gold sensitization.

The emulsion of the present invention can be used in any silver halide photographic element. This includes silver halide photographic film, silver halide photographic papers, negative working elements, positive working elements, reversal photographic elements and the like.

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, Nov. 1992, or a transparent magnetic recording layer such as a layer containing magnetic particles on the underside of a transparent support as in U.S. Pat. No. 5 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September. 1996, Number. 389, Item 38957, which will be identified hereafter by the term "Research Disclosure I ." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forning couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; GE 2,842,063, GE 2,937,127; GE 3,636,824; GE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, Novemver. 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as escribed in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area.

The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular gain emulsions—i.e., ECD/t=2 to 5. The emulsions typically exhibit high tabularity (T), where T (i.e., $ECD/t^2$)>25 and ECD and t are both measured in micrometers ($\mu$m). The tabular grains can be of any thickness compatible with achieving an aim average aspect ratio and/or average tabularity of the tabular grain emulsion. Preferably the tabular grains satisfiing projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements. When the native blue absorption of iodohalide tabular grains is relied upon for blue speed, thicker tabular grains, typically up to 0.5 $\mu$m in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in tthe art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure*, Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexa-coordination complexes containing one or more organic ligands, as taught by Olm et al U.S. Pat. No. 5,360,712, the disclosure of which is here incorporated by reference. It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be usefull in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the. invention can be processed in any of a number of well-known photographic processes utilizing any of a number of well-known processing compositions, described, for example, in *Research Disclosure I*, or in T. H. James, editor, *The Theory of the Photographic Process*, 4th Edition, Macmillan, New York, 1977. In the case of processing a negative worldng element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Patent No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

Next, a more detailed description of the invention will be made. However, it is to be understood that the present invention is not limited to the following examples.

EXAMPLES

All organotin, organobismuth, organoborane, and organolead compounds disclosed below were commercially available organometallic compounds. Methanol solutions were prepared unless otherwise indicated.

In the following examples, experiments were conducted on a photographic element having the following single layer coating format (g/m$^2$):

| | | |
|---|---|---|
| Overcoat | Gelatin | 3.2 |
| | Glycerine | 4.1 |
| Yellow pack | Silverbromoiodide emulsion | 1.9 |
| | Gelatin* | 3.2 |
| | Yellow dye forming Coupler C-1 | 1.4 |
| | Coupler C-2 | 0.075 |
| | Coupler C-3 | 0.005 |
| | Absorbing dye AD | 0.063 |
| | Support | |

*1.4 g/m$^2$ as melt gel, balance from emulsion and dispersions

AD

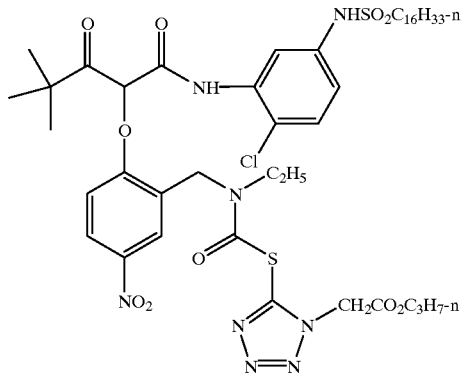

C-1

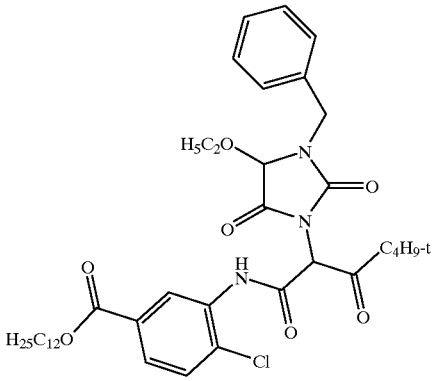

-continued

C-2

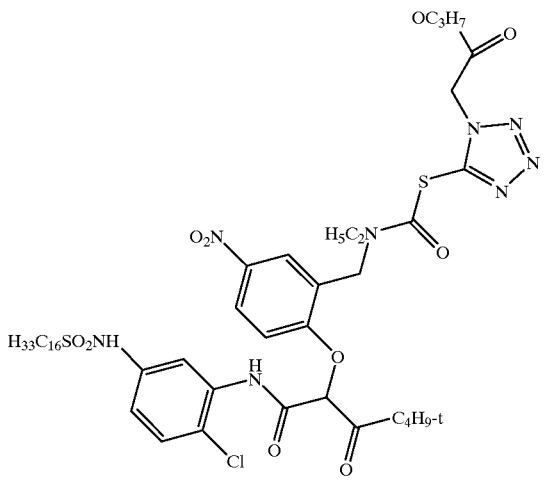

C-3

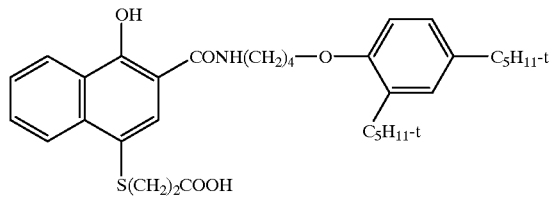

Hardener (bis(vinylsulfonyl)methane hardener at 1.75% of total gelatin weight), antifoggants (including 4-hydroxy-6-methyl-1,3,3a,7-tetraazaindene), surfactants, coating aids, emulsion addenda, sequestrants, lubricants, matte and tinting dyes were added to the appropriate layers as is common in the art.

The silver bromoiodide emulsion is a 1.3% iodide 98.7% /obromide T-grain emulsion 0.55 by 0.084 micron in size. The emulsion was chemical sensitized with sulfur and gold and spectrally sensitized with a blue sensitizing dye BSD-1

BSD-1

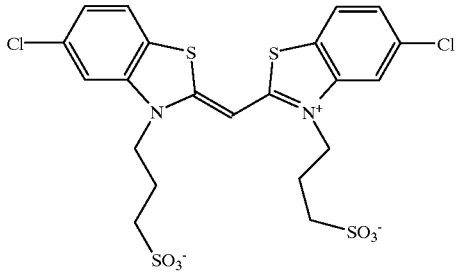

Example 1

A methanol solution containing the organometallic compounds (I) as indicated in Table 1 above was added to the melted emulsion containing the addenda disclosed in Table 1. The mixture was then moved to chlill bath.

Coatings were exposed at 5500° K with a Wratten 47 filter at 1/50" and processed using a 3'15" development time in KODAK PROCESS C-41®. Incubation was carried out at both two and four weeks using −17, 33 and 43° C. at 50% RH with Latent Image Keeping (LIK) measured at the 33° C. condition.

A control element having the structure indicated in Table 1 without organometallic compound (I) was also experimented.

Results are shown in Table 2 below. In these experiments organometallic compounds (I) were added to the emulsion and held briefly at 40° C. The added organometallic compound (I) are indicated in Table 2.

Table 2 includes Fog (Dmin) and Speed data from the 2 weeks/17° C./50% RH incubation control. It also includes Delta Fog data comparing for the same photographic element, the fog from the 2 weeks/43° C./50% RH incubation sample to the 2 weeks/−17° C./50% RH control and Delta LIK (latent image keeping) that is Delta speed data from comparing the latent image keeping (LIK) behavior of 1 week/33° C./50% RH+1 week/33° C./50%RH LIK to the 2 weeks/33° C./50% RH control.

TABLE 2

| Addenda | Level[a] | Fog[b] | Speed[c] | Delta Fog[d] | Delta LIK[e] |
|---|---|---|---|---|---|
| Control | none | 0.19 | 1.32 | 0.14 | −0.20 |
| Tetravinyltin | 0.018 | 0.19 | 1.39 | 0.16 | |
| Tetravinyltin | 0.070 | 0.22 | 1.47 | 0.28 | −0.18 |
| Vinyltributyltin | 0.018 | 0.19 | 1.33 | 0.12 | −0.15 |
| Vinyltributyltin | 0.070 | 0.18 | 1.33 | 0.14 | −0.15 |

[a]mmol/silver mole

[b]Dmin in density from 2 weeks/−17° C./50% RH incubation condition

[c]Relative speed in LogE units at 0.2 density above Dmin from 2 weeks/−17° C./50% RH incubation condition.

[d]Density difference from the from Dmin at 2 weeks/43° C./50% RH incubation condition minus Dmin from 2 weeks/−17° C./50% RH incubation condition.

[e]Speed difference in LogE from Speed taken at 0.2 density above Dmin from the 1 week/33° C./50% RH + 1 week/33° C./50% RH LIK minus speed from the 2 weeks/33° C./50% RH incubation condition.

This table shows that Tetravinyltin exhibits a speed effect. Vinyltributyltin produces a smaller speed effect, however it offers some benefit in LIK behavior.

Example 2

In these experiments, organometallic compounds were added to the emulsion in the conditions similar to the conditions of example 1 except that the addition of the organometallic compounds is followed by a 5 minutes at 60° C. hold step. The added organometallic compound (I) are indicated in Table 3 below. Table 3 includes Fog (Dmin) and Speed data from the 4 weeks/−17° C./50% RH incubation control. It also includes Delta Fog data comparing the fog from the 4 weeks/43° C./50% RH incubation sample to the 4 weeks/ −17° C./50% RH control and Delta LIK, that is Delta speed data from comparing the latent image keeping (LIK) behavior of 3 weeks/33° C./50% RH+1 week/33° C./50% RH LIK to the 4 weeks/33° C./50% RH control.

TABLE 3

| Addenda | Level[a] | Fog[b] | Speed[c] | Delta Fog[d] | Delta LIK[e] |
|---|---|---|---|---|---|
| Control | none | 0.21 | 1.32 | 0.17 | −0.16 |
| Tetravinyltin | 0.02 | 0.22 | 1.36 | 0.19 | −0.15 |
| Tetravinyltin | 0.04 | 0.23 | 1.39 | 0.24 | −0.16 |
| Tetravinyltin | 0.08 | 0.31 | 1.49 | 0.52 | −0.16 |
| Tetraallyltin | 0.002 | 0.22 | 1.33 | 0.17 | −0.16 |
| Tetraallyltin | 0.008 | 0.25 | 1.37 | 0.15 | −0.15 |
| Tetraallyltin | 0.020 | 0.34 | 1.45 | 0.12 | −0.15 |
| Tetraallyltin** | 0.080 | 1.89 | 1.30 | 0.31 | −0.6 |
| Tetraphenyltin | 0.080 | 0.25 | 1.34 | 0.13 | −0.16 |
| Tetraphenyltin | 0.320 | 1.10 | 1.42 | 0.15 | −0.13 |
| 4-Triphenylstannyl benzoic acid sodium salt | 0.160 | 0.22 | 1.34 | 0.14 | −0.16 |

**Speed and incubation not meaningful due to high fog.
[a]mmol/silver mole
[b]Dmin in density from 2 weeks/−17° C./50% RH incubation condition
[c]Relative speed in LogE units at 0.2 density above Dmin from 2 weeks/−17° C./50% RH incubation condition.
[d]Density difference from the from Dmin at 2 weeks/43° C./50% RH incubation condition minus Dmin from 2 weeks/−17° C./50% RH incubation condition.
[e]Speed difference in LogE from Speed taken at 0.2 density above Dmin from the 1 week/33° C./50% RH + 1 week/33° C./50% RH LIK minus speed from the 2 weeks/33° C./50% RH incubation condition.

This clearly shows that the exemplified organometallic compounds (I) exhibit boosts in speed. The most desirable level of tetravinyltin is between 0.04 and 0.08 mmol/silver mol. The most desirable level of tetraallyltin is between 0.008 and 0.020 inmol/silver mol, the tetraallyltin addenda producing significant fog when the level was raised above 0.02 inmol/silver mol. The fog growth at a low level of tetraallylin following incubation at 43° C. was similar to the control whereas the speed was boosted. Tetraphenyltin was difficult to dissolve requiring acetonitrile to prepare an addenda solution. Fog growth and speed gain with tetraphenyltin were seen only at very high levels.

Example 3

In this example, organotin compounds with mixed halogen-allyls were experimented in the same conditions as example 2. In table 5 below, divinyltin dichloride and diallyltin dibromide were evaluated at a higher level than in Table 4.

TABLE 4

| Addenda | Level[a] | Fog[b] | Speed[c] | Delta Fog[d] | Delta LIK[e] |
|---|---|---|---|---|---|
| Control | none | 0.20 | 1.24 | 0.06 | −0.20 |
| Tetravinyltin | 0.040 | 0.28 | 1.50 | 0.32 | −0.17 |
| Tetravinyltin | 0.080 | 0.37 | 1.55 | 0.42 | −0.17 |
| Divinyltin dichloride | 0.400 | 0.21 | 1.36 | 0.16 | −0.17 |

TABLE 4-continued

| Addenda | Level[a] | Fog[b] | Speed[c] | Delta Fog[d] | Delta LIK[e] |
|---|---|---|---|---|---|
| Dimethyltin dichloride | 0.400 | 0.20 | 1.25 | 0.05 | −0.22 |
| Tetraallyltin | 0.010 | 0.30 | 1.41 | 0.0 | −0.16 |
| Tetraallyltin | 0.020 | 0.80 | 1.51 | 0.0 | −0.15 |
| Diallyltin dibromide | 0.180 | 0.24 | 1.37 | 0.03 | −0.16 |
| Diphenyltin dichloride | 0.400 | 0.20 | 1.26 | 0.04 | −0.21 |

[a]mmol/silver mole
[b]Dmin in density from 2 weeks/−17° C./50% RH incubation condition
[c]Relative speed in LogE units at 0.2 density above Dmin from 2 weeks/−17° C./50% RH incubation condition.
[d]Density difference from the from Dmin at 2 weeks/43° C./50% RH incubation condition minus Dmin from 2 weeks/−17° C./50% RH incubation condition.
[e]Speed difference in LogE from Speed taken at 0.2 density above Dmin from the 1 week/33° C./50% RH + 1 week/33° C./50% RH LIK minus speed from the 2 weeks/33° C./50% RH incubation condition.

TABLE 5

| Addenda | Level[a] | Fog[b] | Speed[c] | Delta Fog[d] | Delta LIK[e] |
|---|---|---|---|---|---|
| Control | none | 019 | 1.21 | 0.07 | −0.20 |
| Tetravinyltin | 0.040 | 0.28 | 1.48 | 0.28 | −0.15 |
| Tetravinyltin | 0.080 | 0.29 | 1.48 | 0.27 | −0.13 |
| Divinyltin dichloride | 1.200 | 0.23 | 1.36 | 0.09 | −0.16 |
| Tetramethyltin | 0.180 | 0.20 | 1.30 | 0.06 | −0.17 |
| Tetramethyltin | 0.400 | 0.21 | 1.33 | 0.06 | . |
| Tetraallyltin | 0.010 | 0.25 | 1.35 | 0.06 | −0.23 |
| Tetraallyltin | 0.020 | 0.43 | 1.48 | 0.02 | −0.16 |
| Diallyltin dibromide | 0.400 | 0.23 | 1.36 | 0.09 | −0.20 |
| Allyltrimethyltin | 0.020 | 0.20 | 1.26 | 0.04 | −0.21 |
| Allyltrimethyltin | 0.180 | 2.40 | . | .[f] | .[f] |

[a]mmol/silver mole
[b]Dmin in density from 2 weeks/−17° C./50% RH incubation condition
[c]Relative speed in LogE units at 0.2 density above Dmin from 2 weeks/−17° C./50% RH incubation condition.
[d]Density difference from the from Dmin at 2 weeks/43° C./50% RH incubation condition minus Dmin from 2 weeks/−17° C./50% RH incubation condition.
[e]Speed difference in LogE from Speed taken at 0.2 density above Dmin from the 1 week/33° C./50% RH + 1 week/33° C./50% RH LIK minus speed from the 2 weeks/33° C./50% RH incubation condition.
[f]Speed and incubation not meaningful due to high fog Substitution of halogen for an organic R-group on tin was demonstrated to influence the R-typing activity. Mixed organotins offer the possibility of an infinite blending of degree of photographic activity. The organotin compound (I) appear to also offer a spectrum of activity with respect to the rate of R-typing as evidenced from the incubation results. Tuning of the desired time window for R-typing is another useful feature for these agents.

Example 4

In these experiments, temperature and hold time conditions following the organometallic compound (I) addition to the emulsion were varied as reported in following Table 6.

The no addenda control is most unresponsive to temperature and holding conditions showing only a slight increase in speed and fog as a function of hold time. The level of Tetravinyltin was 0.08 mmo/silver mole, the level of Tetraallyltin was 0.02 mmol/silver mole. The level was chosen that provided the optimum speed enhancement.

Table 6 includes Fog (Dmin) and Speed data from the 2weeks/−17° C./50% RH incubation control, Delta Fog data comparing the fog from the 2 weeks/43° C./50% RH incubation sample to the 2 weeks/−17° C./50% RH control

TABLE 6

| HOLD → Compound | 40° C. for 5 min | | 55° C. for 4.5 min | | 55° C. for 9 min | | 55° C. for 27 min | |
|---|---|---|---|---|---|---|---|---|
| (I) | Dmin[a] | Speed[b] | Fog[a] | Speed[b] | Fog[a] | Speed[b] | Fog[a] | Speed[b] |
| control | 0.19 | 1.14 | 0.20 | 1.15 | 0.21 | 1.16 | 0.21 | 1.17 |
| etravinyltin | 0.23 | 1.27 | 0.32 | 1.48 | 0.43 | 1.48 | 0.41 | 1.40 |
| Tetraallyltin | 0.25 | 1.23 | . | . | 0.43 | 1.32 | 0.51 | 1.35 |
| addenda | Delta Fog[e] | | Delta Fog[e] | | Delta Fog[e] | | Delta Fog[e] | |
| control | 0.07 | | 0.07 | | 0.07 | | 0.08 | |
| etravinyltin | 0.22 | | 0.43 | | 0.52 | | 0.37 | |
| Tetraallyltin | 0.07 | | . | | 0.01 | | 0.00 | |

[a]Dmin in density from 2 weeks/−17° C./50% RH incubation condition
[b]Relative speed in LogE units at 0.2 density above Dmin from 2 weeks/−17° C./50% RH incubation condition.
[e]Density difference from the Dmin in density from the 2 weeks/43° C./50% RH incubation condition minus Dmin in density from 2 weeks/−17° C./50% RH incubation condition.

Example 6

A solution phase assay was used to determine the ability of other organometallic compounds such as orgonolead, organobismuth or organoboron compounds to accomplish the necessary ligand transfer to silver, followed by homolytic cleavage of the thus formed organosilver compound, to provide a silver atom. In this assay, a tetrahydofuran solution of silver acetate or triflate, was reacted with an equivalent of the organometal species to be tested. A positive test was evidenced by the formation of a silver mirror on the walls of the reaction vessel. By this method tetraphenyltin, tetraphenyllead, triphenylbismuth and triphenyl boron all gave positive tests. It is our belief that based on this predictive assay, all of these compounds should accomplish reduction sensitization.

All these examples show that organometallic compound (I) exhibit reduction sensitization ability.

The invention has been described in detail with particular reference to certain preferred embodiments thereof, but it will be understood that variations and modifications can be effected within the spirit and scope of the invention.

What is claimed is:

1. A photographic emulsion comprising dispersed in a binder sensitized silver halide grains wherein the emulsion is sensitized from an organometallic compound of formula:

$$(R)_n(X)_mM \qquad (I)$$

wherein M is a metal selected from the group consisting of lead, tin, boron, bismuth and thallium, each R is independently an alkyl group, a cycloalkyl group, an aryl group, a heterocyclic group, an alkenyl group or a alkynyl group, each X is independently halogen, hydroxy, or alkoxy, n is 1 to 4 and m is 0 to 3, with the proviso that when M is lead or tin, n is 1 to 4 and m+n is 4, when M is boron or bismuth, n is 1 to 3 and m+n is 3 and when M is thallium, either n is 1 and m is 0, or n is 1 to 3 and n+m is 3.

2. The photographic emulsion according to claim 1 wherein M is tin.

3. The photographic emulsion according to claim 1, wherein R is independently an alkyl group, a cycloalkyl group or a heterocyclic group having from 1 to 20 carbon atoms, an aryl group, an alkenyl group, or a alkynyl group having from 2 to 20 carbon atoms.

4. The photographic emulsion according to claim 1 wherein the organometallic compound has the formula:

$$R_4Sn \qquad (Ia)$$

wherein each R is independently alkyl, cycloalkyl, or heterocyclic, aryl, alkenyl or alkynyl group.

5. The photographic emulsion of claim 4 wherein R is selected from the group consisting of alkyl, vinyl or allyl.

6. The photographic emulsion of claim 1 wherein at least one of the R groups comprises a hydrophilic substituent.

7. The photographic emulsion of claim 1 wherein the organometallic compound is selected from tetravinyltin, vinyltributyltin, tetraallyltin, tetraphenyltin, divinyltin dichloride, dimethyltin dichloride, tetramethyltin, diallyltin dibromide, dichloride, allyltrimethyltin.

8. A photographic element comprising at least one silver halide emulsion and a support wherein the emulsion comprises dispersed in a binder sensitized silver halide grains, the emulsion being sensitized from an organometallic as defined in claim 1.

9. A method for sensitizing a photographic silver halide emulsion containing dispersed in a binder silver halide grains, comprising the step of adding to the emulsion an organometallic compound as defined in claim 1 in an amount capable of enhancing the sensitivity of the element.

10. The method of claim 9 further comprising a step of holding the emulsion containing the organometallic compound at a temperature between 40 and 60° C. for a time sufficient to enhance the sensitivity of the emulsion.

11. The method of claim 9 wherein M is tin.

12. A photographic element comprising a support having thereon a silver halide emulsion layer wherein the emulsion layer has been sensitized by addition to the emulsion an organometallic as defined in claim 1 an amount capable of enhancing the element sensitivity.

13. A method for improving the image latent keeping of a photographic element comprising a support having thereon a silver halide emulsion layer, said method comprising the step of adding to the emulsion an organometallic compound of formula:

$$(R)_n(X)_mM \qquad (I)$$

wherein M is a metal selected from the group consisting of lead, tin, boron, bismuth and thallium, each R is independently an alkyl group, a cycloalkyl group, an aryl group, a heterocyclic group, an alkenyl group or a alkynyl group, each X is independently halogen, hydroxy, or alkoxy, n is 1 to 4 and m is 0 to 3, with the proviso that when M is lead or tin, n is 1 to 4 and m+n is 4, when M is boron or bismuth, n is 1 to 3 and m+n is 3 and when M is thallium, either n is 1 and m is 0, or n is 1 to 3 and n+m is 3.

* * * * *